US006820317B2

(12) United States Patent
Okada

(10) Patent No.: US 6,820,317 B2
(45) Date of Patent: Nov. 23, 2004

(54) METHOD OF MAKING A METALLIC BELLOWS

(75) Inventor: Hideki Okada, Kanagawa (JP)

(73) Assignee: NHK Spring Co., Ltd., Kanagawa (JP)

( * ) Notice: Subject to any disclaimer, the term of this patent is extended or adjusted under 35 U.S.C. 154(b) by 158 days.

(21) Appl. No.: 10/337,566

(22) Filed: Jan. 7, 2003

(65) Prior Publication Data

US 2003/0126732 A1 Jul. 10, 2003

(30) Foreign Application Priority Data

Jan. 8, 2002 (JP) ..... 2002-001743

(51) Int. Cl.[7] ..... B21J 5/04

(52) U.S. Cl. ..... 29/421.1; 29/454; 72/56; 72/58; 72/61; 72/62; 428/586

(58) Field of Search ..... 29/421.1, 522.1, 29/454; 72/56, 57, 58, 59, 60, 61, 62; 148/DIG. 3; 428/586

(56) References Cited

U.S. PATENT DOCUMENTS 4,319,471 A 3/1982 Benteler-Werke
4,369,074 A * 1/1983 Bodyako et al. ..... 148/566
6,386,012 B2 * 5/2002 Minamidate et al. ..... 72/302
6,564,606 B2 * 5/2003 Okada et al. ..... 72/59

FOREIGN PATENT DOCUMENTS

| | | | | |
|---|---|---|---|---|
| EP | 0 250 838 A | | 1/1988 | |
| GB | 917 806 A | | 2/1963 | |
| JP | 61 159230 A | | 7/1986 | |
| JP | 02 134466 A | | 5/1990 | |
| JP | 02145724 A | * | 6/1990 | ..... C21D/9/00 |
| JP | 06281000 A | * | 10/1994 | ..... F16J/3/04 |

* cited by examiner

*Primary Examiner*—David P. Bryant
*Assistant Examiner*—Jermie E. Cozart
(74) *Attorney, Agent, or Firm*—Marshall & Melhorn, LLC

(57) ABSTRACT

In a method of fabricating a bellows by bulge forming, an annealing step is carried out during the bulge forming process of the bellows so that the capability of the material to elongate is recovered, and the workability of the bellows is improved in effect. In particular, the ratio of the outer diameter to the inner diameter can be made greater than a value that can be achieved by a single forming step. Therefore, the deflection (stroke) of each annular bulge or pleat can be increased for a given stress or the number of annular bulges and the length of the bellows can be decreased for a given stroke of the bellows.

12 Claims, 6 Drawing Sheets

METHOD OF MAKING A METALLIC BELLOWS

TECHNICAL FIELD

The present invention relates to a metallic bellows and in particular to a method of making a metallic bellows.

BACKGROUND OF THE INVENTION

Metallic bellows have a wide range of applications, and a typical application is found in pressure accumulators owing to its capability to seal off gas and withstand repeated extension and contraction. Conventionally, a metallic bellows was typically made by welding together appropriately shaped metallic sheets. However, this fabrication method is not suited for mass production because of the difficulty in carrying out the welding process with a required precision and uniformity. For this reason, stamp formed bellows have come to be preferred over the more conventional welded bellows. A bellows can be stamp formed most conveniently by introducing pressurized liquid into an enclosed metallic tube blank which is surrounded by a suitable metallic die assembly, and this may be called as the hydraulic bulge method.

The stress of the bellows can be computed from the well-known formula specified in "Japan Industrial Standards (JIS) B 8243 Structure of Pressure Vessels" and given in the following.

$$\sigma_x = 1.5 \times t \times \Delta_x \times E / \{(\rho/2)^{0.5} \times h^{1.5} \times 2n\} \quad (1)$$

where $\sigma_x$: the stress produced by the extension and contraction of the bellows (MPa), t: plate thickness (mm), $\Delta_x$: axial deflection (mm), E: Young's modulus (179 GPa in the case of SUS 304), n: effective number of annular bulges, ρ: pitch (mm), and h: height of each bulge (mm).

As can be appreciated from this formula, increasing the height of each annular bulge is effective in reducing the stress of the bellows. The bulge height can be given by (outer diameter−inner diameter)/2, and the inner diameter is given by the inner diameter of the metallic tube blank. Therefore, by increasing the outer diameter/inner diameter ratio, the bulge height can be increased and the stress of the bellows can be reduced. Also, for the given permissible stress, by increasing the height of each annular bulge, the number of bulges can be reduced, and the axial length of the bellows can be thereby reduced. This contributes to a compact design, and enables the bellows to be used in a limited space. For instance, a pressure accumulator using such a bellows can be made highly compact, and the freedom in the accumulator design can be enhanced.

However, according to the prior art, the height of each annular bulge was limited by the capability of the material to elongate. In other words, if an attempt is made to achieve a bulge height which is more than the maximum elongation of the material permits, the material ruptures. Therefore, conventionally, the bulge height was only so large as the elongation of the material permitted, and could not be increased so much as desired.

For instance, when SUS304 is used for making a bellows by the conventional hydraulic bulge method, due to the limit in the elongation of the material, the ratio of the outer diameter to the inner diameter (D1/D2) cannot be any more than about 1.5. This puts a limit to the possible stroke of the bellows for the given size of the bellows.

Such a problem can be mitigated by using materials capable of larger elongations. However, a material demonstrating a larger elongation is relatively expensive, and this increases the manufacturing cost. Alternatively, instead of using a forming process, the bellows may be fabricated by the welding method which provides a greater freedom in design without being encumbered by such a limitation. However, when making a bellows by welding, it is necessary to weld the circumference of each of a plurality of annular thin plates, and this complicates the manufacturing process. This not only increases the manufacturing cost but also causes some difficulty in ensuring the required capability to withstand repeated loads due to the unavoidable variations in the quality of welding.

BRIEF SUMMARY OF THE INVENTION

In view of such problems of the prior art, a primary object of the present invention is to provide a method of making a bellows which provides a larger stroke for a given size.

A second object of the present invention is to provide a method of making a bellows which provides a larger stroke for a given level of stress.

A third object of the present invention is to provide a method of making a bellows which provides a larger stroke for a given selection of material.

According to the present invention, such objects can be accomplished by providing a method of fabricating a bellows by bulge forming, comprising the steps of: placing a metallic tube blank in a first die assembly; introducing pressurized fluid into the metallic tube blank so as to form a plurality of annular bulges in the metallic tube blank in cooperation with the first die assembly; removing the metallic tube blank from the first die assembly and annealing the metallic tube blank; placing the annealed metallic tube blank in a second die assembly; and introducing pressurized fluid into the metallic tube blank so as to further bulge out the annular bulges of the metallic tube blank in cooperation with the second die assembly.

According to this method, by conducting the annealing step during the bulge forming process of the bellows, the capability of the material to elongate is recovered, and the workability of the bellows is improved in effect so that an additional forming step can be conducted upon the bellows which has been subjected to the previous forming step.

In particular, the ratio of the outer diameter to the inner diameter can be made greater than a value that can be achieved by a single forming step. Therefore, the deflection (stroke) of each annular bulge or pleat can be increased for a given stress or, in other words, the number of annular bulges can be decreased and the length of the bellows can be decreased for a given stroke of the bellows.

Typically, the metallic tube blank is made of stainless steel, but other materials can be used without departing the spirit of the present invention. Also, the first and second die assemblies may consist of a common die assembly, instead of being two different die assemblies.

According to a preferred embodiment of the present invention, the die assembly comprises an upper die component, a lower die component and a plurality of intermediate annular die components arranged between the upper and lower die components at an equal interval. In particular, each of the intermediate annular die components is preferably provided with an annular ridge defining annular recesses on either side thereof, the recesses of the intermediate annular die components jointly defining an outer profile of the annular bulges of the metallic tube blank. Preferably, the intermediate annular die components are adapted to be brought closer to each other uniformly as the pressurized fluid is introduced into the metallic tube blank. Each of the upper and die component is preferably provided with a plug that fits into a corresponding axial end of the metallic tube blank in a liquid tight manner. This allows the interior of the metallic tube blank to be conveniently sealed off, and the liquid for pressurization can be introduced in to the interior of the metallic tube blank from a passage formed in one of the plugs.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
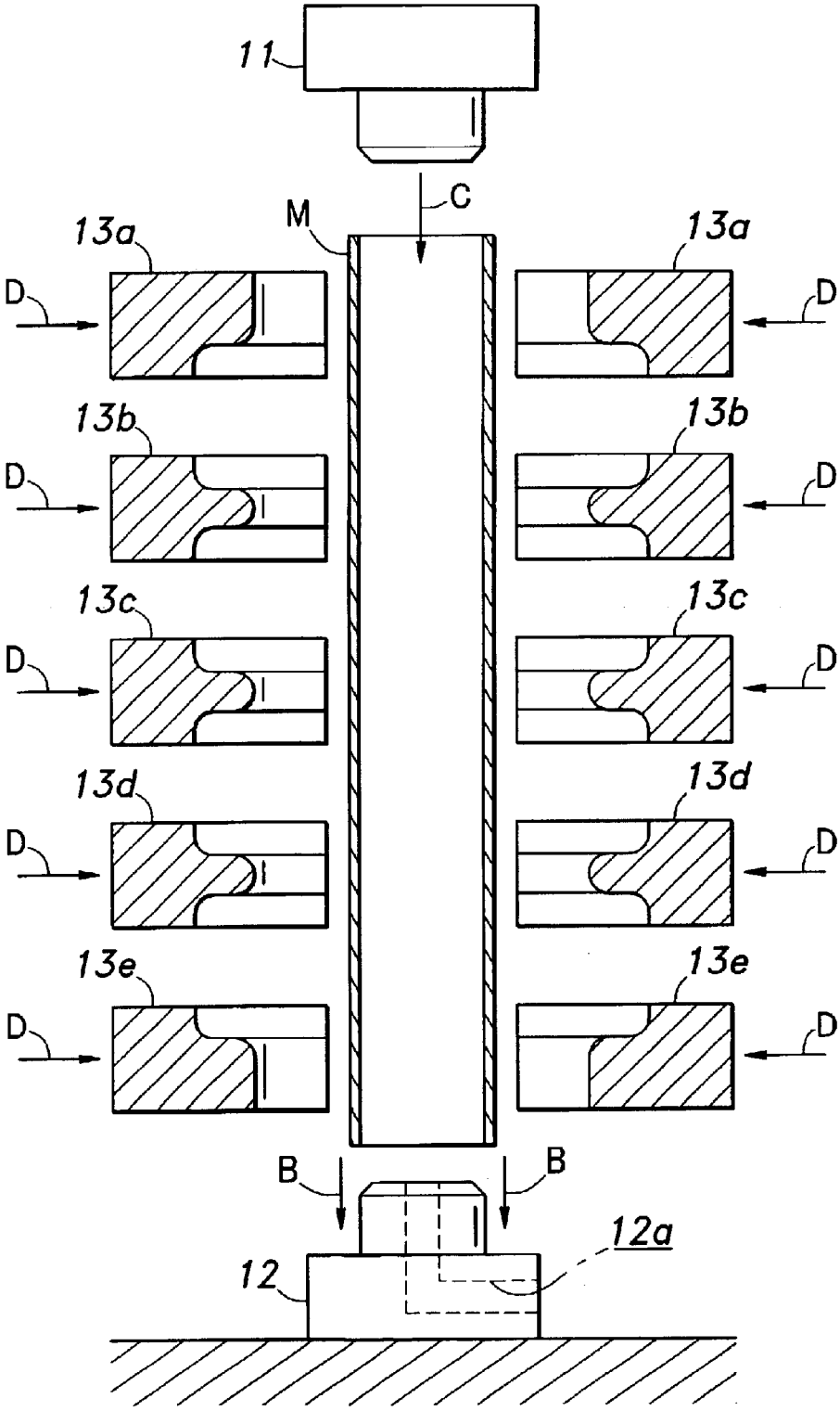
FIG. 1 is a schematic sectional side view of a metallic die assembly that can be used for implementing the method of the present invention, having a metallic tube blank placed therein.
Figure 2:
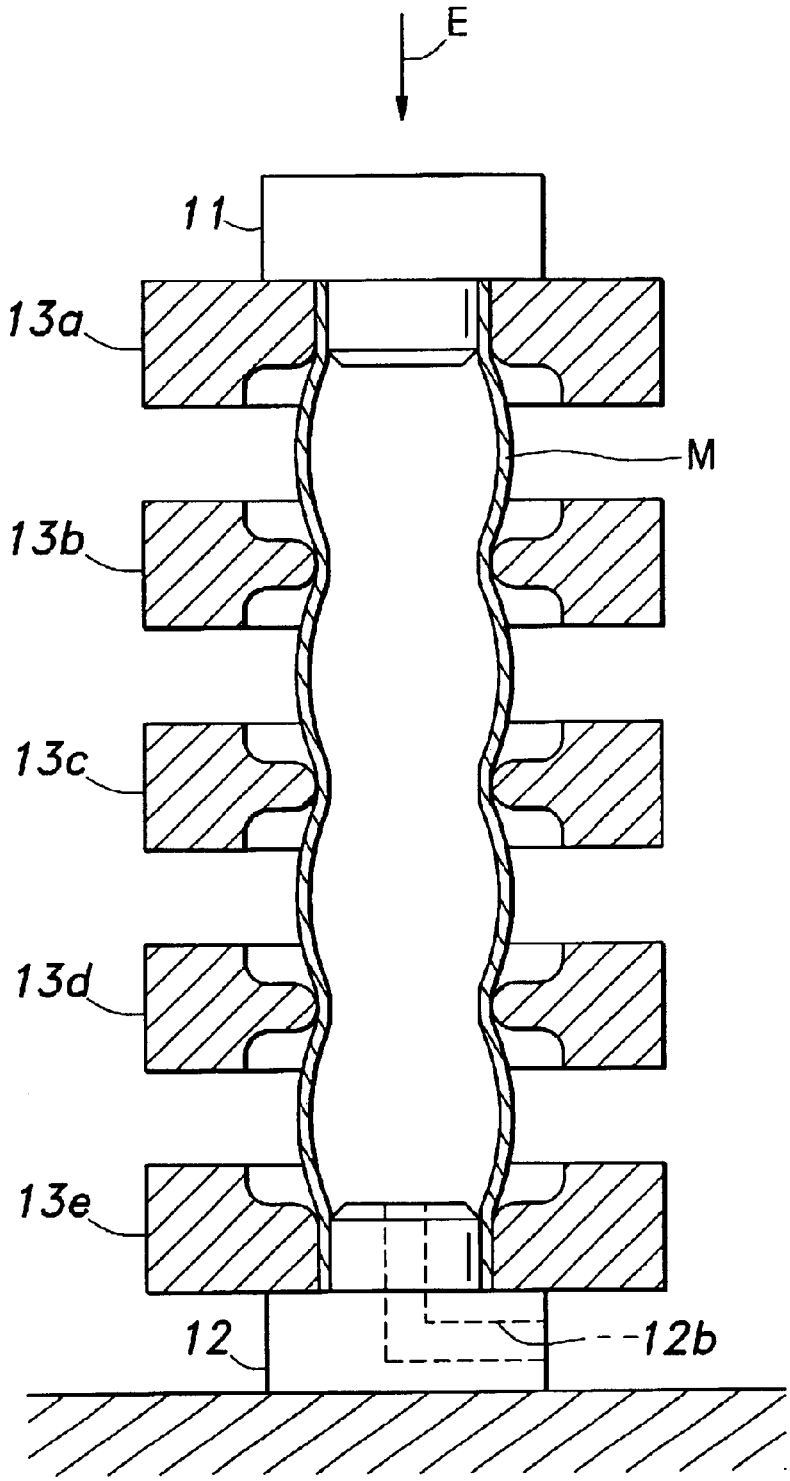
FIG. 2 is a view similar to FIG. 1 showing an intermediate stage of the forming process.
Figure 3:
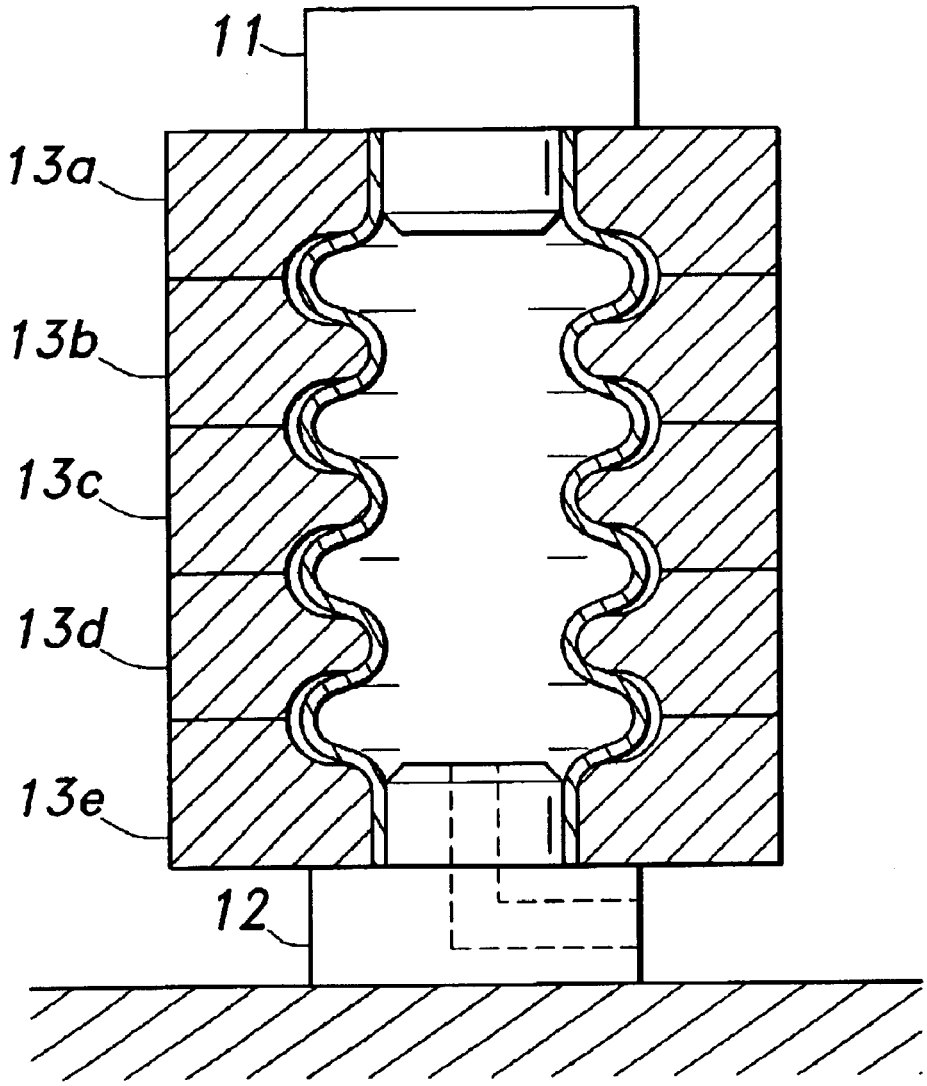
FIG. 3 is a view similar to FIG. 1 showing a final stage of the forming process.

FIGS. 1 to 3 show the method of making a bellows from a blank consisting of a metallic tube blank M for instance made of stainless steel such as SUS304. Referring to FIG. 1, the metallic die assembly for the forming process includes an upper metallic die component 11 and a lower metallic die component 12 for closing the two axial ends of the metallic tube blank M and a plurality of annular intermediate metallic die components 13*a* to 13*e* each surrounding the metallic tube blank M and arranged at an equal interval along the axial direction. The metallic tube blank M is placed on the lower metallic die component 12 as indicated by arrow B in the drawing, and the upper metallic die component 11 is placed on the upper end of the metallic tube blank M as indicated by arrow C in the drawing. The upper and lower metallic die components 11 and 12 are each provided with a cylindrical projection or a plug that fits into the corresponding end of the metallic tube blank M in a liquid tight manner. Each of the annular intermediate metallic die components 13*a* to 13*e* consists of semi-circular halves which are adapted to jointly define the annular shape when they are placed around the outer circumferential surface of the metallic tube blank M as indicated by arrow D in FIG. 1. Furthermore, the inner circumferential surface of each intermediate metallic die component is provided with a central annular ridge having a rounded top as seen in cross section.

FIG. 2 shows the initial step of forming the bellows. The metallic tube blank M is closed by the upper and lower metallic die components 11 and 12, and liquid for pressurization is filled into the metallic tube blank M from a pressurization passage 12*a* formed in the lower metallic die component 12.

The liquid under pressure which is filled into the metallic tube blank M causes the parts (or recesses) of the metallic tube blank M located between the central annular ridges of the intermediate metallic die components 13*a* to 13*e* to bulge radially outwardly. The parts of the metallic tube blank M supported by the central annular ridges of the intermediate metallic die components are prevented from bulging radially outwardly. Then, the upper metallic die component 11, along with the intermediate metallic die components 13*a* to 13*e*, is gradually lowered toward the lower metallic die component 12 as shown by arrow E in FIG. 2. The upper metallic die component 11 and intermediate metallic die components 13*a* to 13*e* are lowered by a drive mechanism not shown the drawing in such a manner that the intervals between the intermediate metallic die components 13*a* to 13*e* are reduced uniformly. While the internal pressure is controlled at an appropriate level, the intervals between the intermediate metallic die components 13*a* to 13*e* are reduced in such a manner as to avoid the rupture or buckling of the bulged portions.

Before the intermediate metallic die components 13*a* to 13*e* are brought into contact with each other and the elongation of the material of the metallic tube blank M reaches its limit, the downward movements of the upper metallic die component 11 and intermediate metallic die components 13*a* to 13*e* are stopped. The dies assembly 11, 12 and 13*a* to 13*e* is then opened up, and the bellows 2 is removed from the metallic die assembly. The ratio of the outer diameter to the inner diameter (the inner diameter is given as the diameter of the blank metallic tube M before the forming step, and the outer diameter is given as the diameter of the part which has bulged out most radially outwardly by the forming process) cannot be greater than a certain value, for instance 1.4 because of the limit of the elongation of the material and various considerations for mass production.

Then, an annealing step is conducted on this bellows which is in the process of being formed into a desired final shape. The annealing step is conducted at a certain temperature over a certain period of time so that the residual stress in the bellows is removed, and the bellows is ready for a new forming process. The annealing step thus renews the capability of the material to elongate, and the workability of the material is thereby improved in effect.

Figure 4:
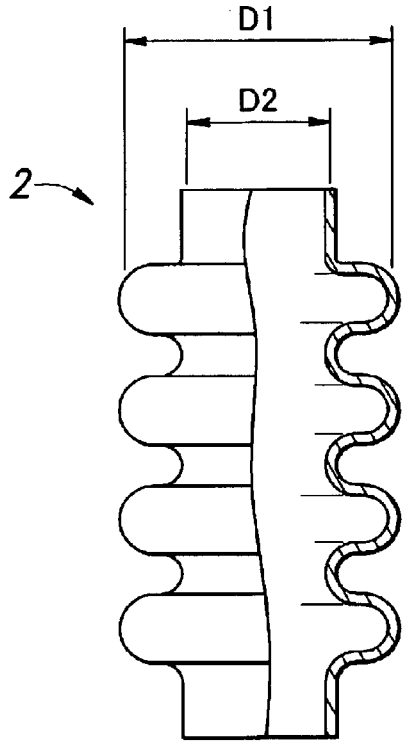
FIG. 4 is a partly broken away side view of a bellows made by the method of the present invention.
Figure 7:
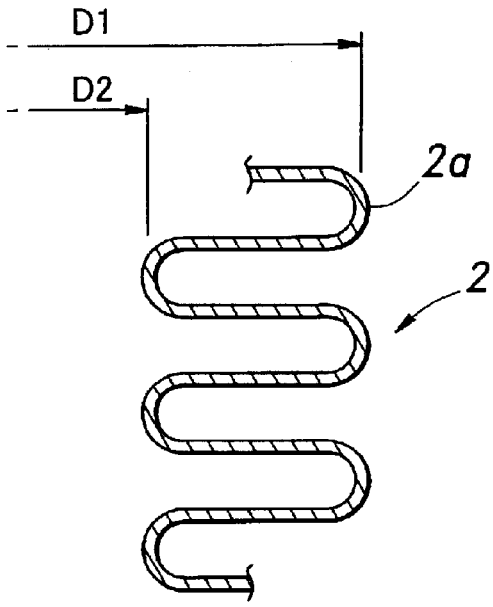
FIG. 7 is a fragmentary enlarged sectional view of the bellows formed by the second forming step.

Then, the bellows is brought back into the metallic die assembly. At this time, the positions of the various components of the metallic die assembly may be required to be slightly adjusted so as to accommodate the spring back of the material and deformation that may have been caused during the annealing step. Again, the upper metallic die component 11 and intermediate metallic die components 13*a* to 13*e* are lowered in such a manner that the intervals between the intermediate metallic die components 13*a* to 13*e* are reduced uniformly, in this case however, until the upper metallic die component 11, intermediate metallic die components 13*a* to 13*e* and lower metallic die component 12 come to closely contact with each other as shown in FIG. 3. When the forming process is completed, the internal pressure is removed, and the metallic die components are opened up. Thus, the bellows 2 having an inner diameter of D2 and an outer diameter of D1 is produced as illustrated in FIGS. 4 and 7.

By thus conducting the two forming steps, each time to such an extent as the capability of the material to elongate permits without rupturing or otherwise causing a permanent damage to the material, and conducting the annealing step between the two forming steps, a bellows having an outer diameter/inner diameter ratio (D1/D2) which is greater than a value that was possible by the conventional hydraulic forming method. For instance, the first forming step is carried out until the ratio reaches 1.4. The annealing step is then carried out, and the second forming step is carried out until the ratio again reaches 1.4 (the inner diameter in this case is given by the most radially outwardly projecting part produced by the first forming process). As a result, a bellows having the outer diameter/inner diameter ratio (D1/D2) of 1.4×1.4=1.96 can be formed.

Figure 6:
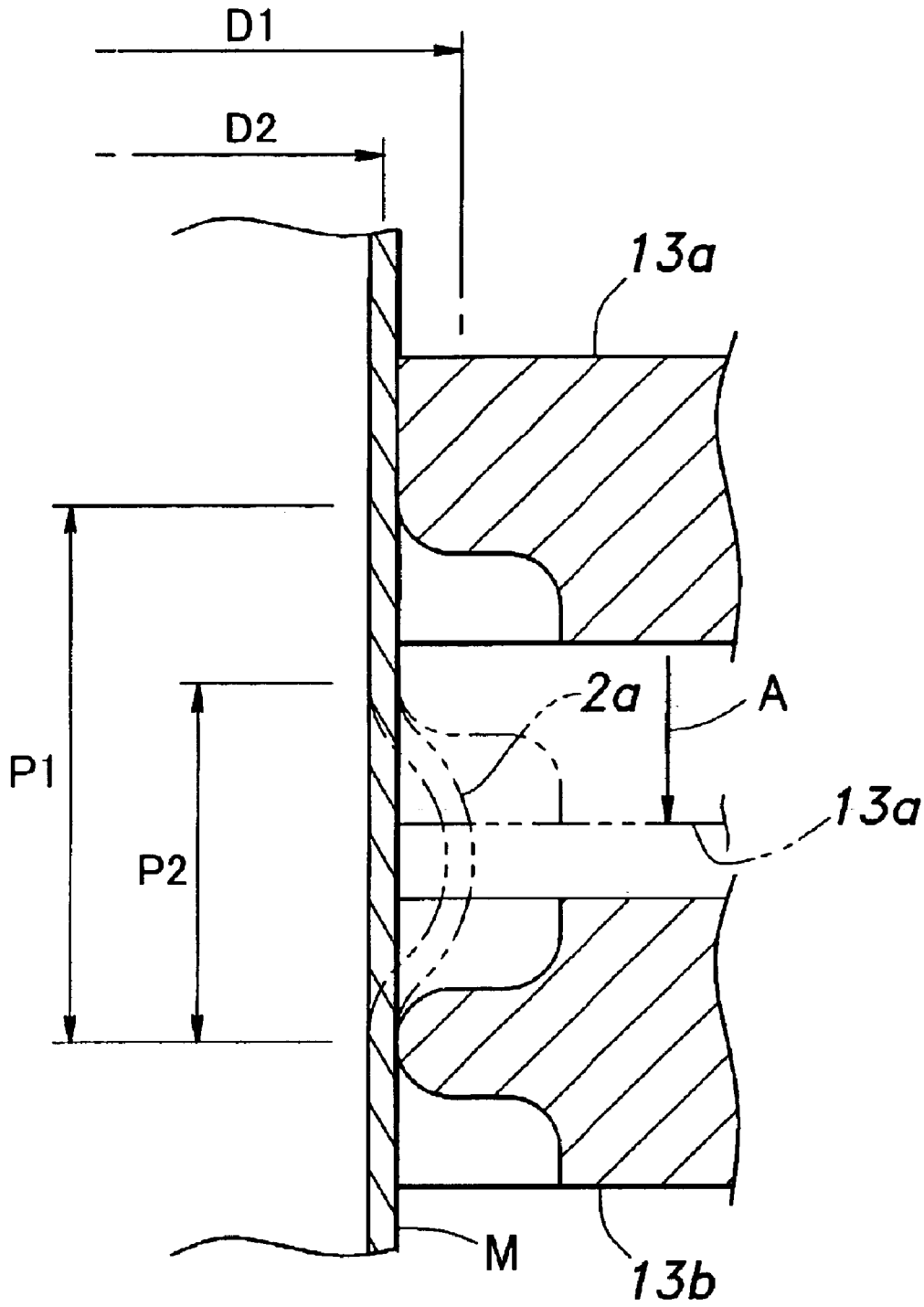
FIG. 6 is a fragmentary enlarged sectional side view illustrating the mode of the first forming step.

More specifically, when only one annealing step is to be carried out, the intermediate metallic die components 13*a* to 13*e* are each provided with an annular recess (corresponding to the annular bulge 2*a* of the bellows 2) having a radial dimension which is approximately twice as large as that of the die assembly for the conventional forming process including no annealing step. In the first forming step, the inner pressure of the bellows 2 is increased and the spaces (or recesses) between the metallic die components are reduced (from P1 to P2 as shown in FIG. 6) in size to produce the bulges 2*a* in such a manner that the outer diameter/inner diameter ratio (D1/D2) is 1.4. The bulges 2*a* are thus produced as indicated by the imaginary lines in FIG. 6. The annealing step is then carried out.

In the subsequent second forming step, the annular bulges 2*a* are further radially outwardly extended until the desired outer diameter/inner diameter ratio (D1/D2) is achieved and the material of the bellows is pushed again the outer wall defined by the recesses of the metallic die assembly defined between the annular ridges while the upper metallic die component 11 and intermediate annular metallic die components 13*a* to 13*e* are brought into contact with each other as illustrated in FIG. 3.

Figure 5:
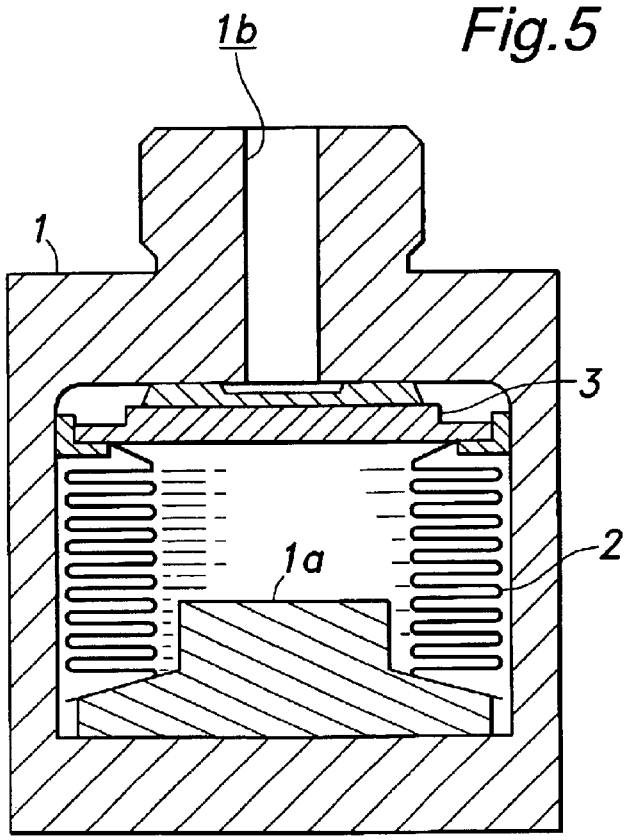
FIG. 5 is a sectional side view of an accumulator using a bellows made by the present invention.

FIG. 5 is a sectional side view of an accumulator using a bellows embodying the present invention. The illustrated accumulator comprises a bellows 2 received in an enclosed case 1. The lower end of the bellows 2 is fixedly attached to a boss 1*a* projecting from the bottom surface of the case 1, and the upper end of the bellows 2 is fixedly attached to a piston plate 3 which is received in the case 1 in a vertically slidable manner. The two axial ends of the bellows 2 are closed by the boss 1*a* and piston plate 3 in an air tight manner.

The top plate of the case 1 is provided with a communication passage 1*b* for communication with the exterior so that liquid can be introduced into and removed out of the interior of the case 1 via the communication passage 1*b*. The bellows 2 is filled with gas of a prescribed pressure. When liquid is introduced into the case 1 against the pressure of the gas in the bellows 2, the piston plate 3 is pushed downward, and the travel of the piston plate 3 depends on the pressure of the liquid. The bellows 2 thus extends and contracts accordingly.

The second forming step was carried out by using the same metallic die assembly as that for the first forming step in the illustrated embodiment. However, it is also possible to use a different metallic die assembly for the second forming step. When a bellows having an outer diameter/inner diameter ratio of 1.96 is to be produced, a die assembly for the outer diameter/inner diameter ratio of 1.4 would be used for the first forming step, and a die assembly for the final outer diameter/inner diameter ratio of 1.96 would be used for the second forming step. The metallic die components were brought into mutual contact at the end of the second forming step in the illustrated embodiment, but it is also possible to move the metallic die components only to come close to each other at the end. Also, when two different die assemblies are used for the two forming steps, it is possible to have the metallic die components to be brought into mutual contact at the end of each of the first and second forming steps.

By thus including the annealing step in the process of forming a bellows, a bellows having a large outer diameter/inner diameter ratio can be produced even when such a large ratio would not be possible with a single forming step due to the nature of the material. Such materials having a limited elongation include SUS631. In this case, because the outer diameter/inner diameter ratio that can be achieved by a single forming step is limited to 1.3, it is necessary to carry out three forming steps and two intervening annealing steps to manufacture a bellow having an outer diameter/inner diameter ratio of 1.96. By thus repeating the annealing step and forming step one after the other, a bellows having any desired outer diameter/inner diameter ratio can be manufactured.

A conventional bellows made by the conventional method including only one forming step for achieving an outer diameter/inner diameter ratio of 1.42 was compared with a bellows made by the method of the present invention including a step of annealing for achieving an outer diameter/inner diameter ratio of 1.76. In both cases, the material was SUS304, and the plate thickness and inner diameter were 0.13 mm and 18 mm, respectively. Therefore, the outer diameter of the conventional bellows was 25.6 mm, and that of the bellows of the present invention was 31.6 mm. The deflection of the bellows was designed to be 6 mm, and the bellows were required to withstand 107 cycles of repeated extension and contraction.

The pressure for the forming step was 9.5 MPa, and the annealing step carried out between two forming steps according to the present invention was carried out in a non-oxidizing furnace for four minutes at 980° C. The two forming steps according to the present invention were conducted in such a manner that a pitch P1 of 15 mm and a pitch P2 of 8.2 mm is obtained. The pitch P2 was 8.9 mm at the beginning of the second forming step due to the spring back, and the second forming step was conducted until all the metallic die components are brought into contact with each other.

Table 1 compares the properties of these two bellows.

TABLE 1

| | bellows (conventional) | bellows (present invention) |
|---|---|---|
| outer diameter (mm) | 25.6 | 31.6 |
| inner diameter (mm) | 18 | 18 |
| number of bulges | 25 | 9 |
| stress (MPa) | 334 | 329 |
| operating range (mm) | 28–34 | 14.7–20.7 |
| reduction in the number of bulges (%) | — | 64 |

As shown in Table 1, for a given stress, the conventional bellows had 25 annular bulges while the bellows of the present invention had only nine annular bulges, a reduction of 64%. This allowed the maximum length of the bellows during use to be reduced from 34 mm to 20.7 mm, reduction of 13.3 mm. Thus for a given stroke of the bellows and a given stress, the present invention allows the (maximum) length of the bellows to be reduced substantially.

Figure 8:
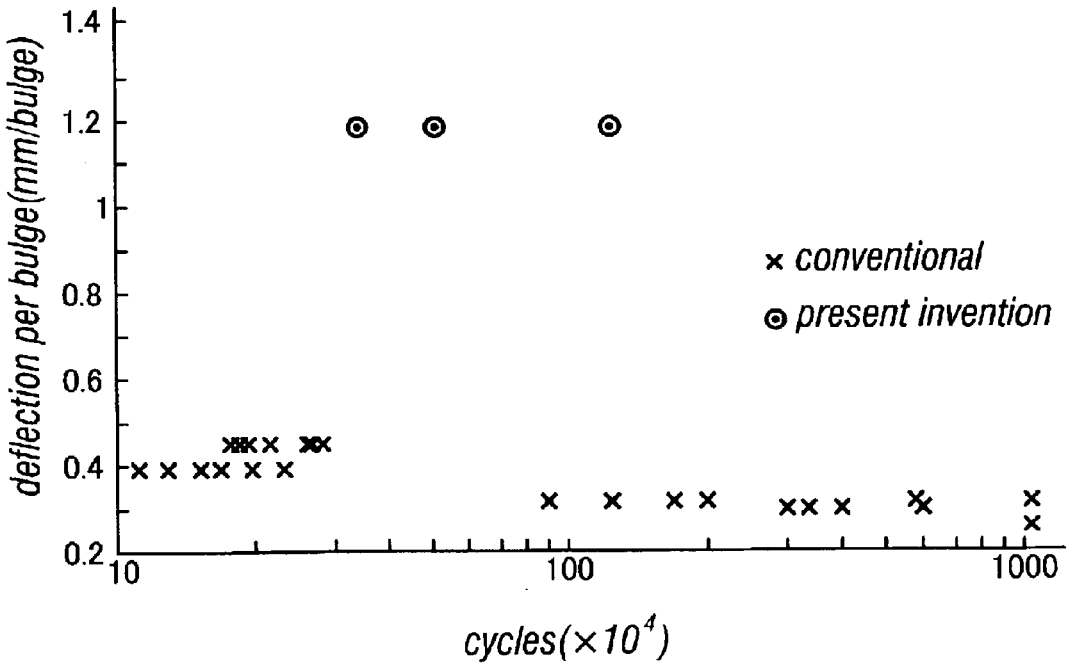
FIG. 8 is a graph showing the deflection of each annular bulge in relation to the number of cycles of extension and contraction.

The results of a fatigue test are shown in FIG. 8. Because the number of annular bulges and stroke are directly related, the ordinate is given by the deflection per annular bulge ((mm/bulge) while the abscissa is given by the number of cycles of extension and contraction.

From the reduction rate of the number of annular bulges, it was expected that the deflection of the bellows of the present invention for each annular bulge would be 2.77 times greater that of the bellows of the prior art. According to the experiment conducted by the inventors, the deflection for each annular bulge after million cycles of operation was about 1.2 mm in the case of the bellows according to the present invention whereas the corresponding value was about 0.3 mm in the case of the prior art. The deflection per each annular bulge of the bellows of the present invention was thus four times greater than that of the bellows of the prior art, and the improvement was substantially more than anticipated.

A single annealing step was carried out between two successive forming steps in the illustrated embodiment, but it is also possible to repeat an annealing step and a forming step for a larger number of times as required. By so doing, it is possible to manufacture bellows having substantially any outer diameter to inner diameter ratio by using various different materials.

Thus, according to the present invention, by interposing an annealing step between two successive forming steps, and carrying out an additional forming step on annular bulges which are formed by the preceding forming step, the workability of the bellows can be improved in effect. Owing to such improvement in the effective workability of the material, it is possible to manufacture a bellows having an outer diameter to inner diameter ratio which is greater than hitherto has been possible with a single forming step according to the prior art. Because the possible deflection for each annular bulge for a given stress increases, the number of annular bulges for a given deflection can be reduced, and the maximum length of the bellows can be reduced. Therefore, a more compact design is possible, and the stroke of the bellows can be increased because the stroke for the given length of the bellows can be increased.

Although the present invention has been described in terms of a preferred embodiment thereof, it is obvious to a person skilled in the art that various alterations and modifications are possible without departing from the scope of the present invention which is set forth in the appended claims.

What is claimed is:

1. A method of fabricating a bellows by bulge forming, comprising the steps of:

placing a metallic tube blank in a first die assembly;

introducing pressurized fluid in said metallic tube blank so as to form a plurality of annular bulges in said metallic tube blank in cooperation with said first die assembly;

removing said metallic tube blank from said first die assembly and annealing said metallic tube blank;

placing said annealed metallic tube blank in a second die assembly; and introducing pressurized fluid into said metallic tube blank so as to further bulge out said annular bulges of said metallic tube blank in cooperation with said second die assembly.

2. A method according to claim 1, wherein said metallic tube blank is made of stainless steel.

3. A method according to claim 1, wherein said first and second die assemblies consist of a common die assembly.

4. A method according to claim 1, wherein said first die assembly comprises an upper die component, a lower die component and a plurality of intermediate annular die components arranged between said upper and lower die components at an equal interval.

5. A method according to claim 4, wherein each of said intermediate annular die components is provided with an annular ridge defining annular recesses on either side thereof, said recesses of said intermediate annular die components jointly defining an outer profile of said annular bulges of said metallic tube blank.

6. A method according to claim 4, wherein said intermediate annular die components are adapted to be brought closer to each other uniformly as said pressurized fluid is introduced into said metallic tube blank.

7. A method according to claim 1, wherein said second die assembly comprises an upper die component, a lower die component and a plurality of intermediate annular die components arranged between said upper and lower die components at an equal interval.

8. A method according to claim 7, wherein each of said intermediate annular die components is provided with an annular ridge defining annular recesses on either side thereof, said recesses of said intermediate annular die components jointly defining an outer profile of said annular bulges of said metallic tube blank.

9. A method according to claim 7, wherein said intermediate annular die components are adapted to be brought closer to each other uniformly as said pressurized fluid is introduced into said metallic tube blank.

10. A method according to claim 9, wherein said intermediate annular die components are adapted to be brought into contact with one another as said pressurizing step in said second die assembly is completed.

11. A method according to claim 1, wherein said upper die component is provided with a plug that fits into a corresponding axial end of said metallic tube blank.

12. A method according to claim 1, wherein said lower die component is provided with a plug that fits into a corresponding axial end of said metallic tube blank.

* * * * *